United States Patent [19]

Heuchert

[11] Patent Number: 4,835,907

[45] Date of Patent: Jun. 6, 1989

[54] AUTOMOTIVE VEHICLE WINDOW DRIVE MECHANISM

[75] Inventor: Karl H. Heuchert, Sao Paulo, Brazil

[73] Assignee: Metalurgica Carto Ltda., Brazil

[21] Appl. No.: 145,566

[22] Filed: Jan. 19, 1988

[30] Foreign Application Priority Data

Jan. 20, 1987 [BR] Brazil ..... 6700075[U]

[51] Int. Cl.[4] ..... E05F 11/48

[52] U.S. Cl. ..... 49/352

[58] Field of Search ..... 49/352, 349

[56] References Cited

U.S. PATENT DOCUMENTS 4,199,899 4/1980 Muhling et al. ..... 49/352
4,306,378 12/1981 Fukura et al. ..... 49/352
4,313,282 2/1982 Hagemann et al. ..... 49/352
4,663,886 5/1987 Nakamura et al. ..... 49/352 X

FOREIGN PATENT DOCUMENTS 3152329 7/1983 Fed. Rep. of Germany ..... 49/352
2029895 3/1980 United Kingdom ..... 49/352

*Primary Examiner*—Philip C. Kannan
*Attorney, Agent, or Firm*—Darby & Darby

[57] ABSTRACT

An automotive vehicle window drive mechanism constituted by supports (1), (4) and (5) arranged in the form of triangle, the two latter having a curved groove (6) in which there is fitted part (7) and on whose facing ends (8) there is fitted the free ends of a vertical rail (9) arranged between lugs (11).

3 Claims, 2 Drawing Sheets

1A
1B
12
12'
13
14
15
16
16'
3
4
5
6
6'
6''
7
7'
8
9
10
11
1
2
4=5

AUTOMOTIVE VEHICLE WINDOW DRIVE MECHANISM

BACKGROUND OF THE INVENTION

The applicant is holder of Brazilian patent MU-5801246 relating to a "Drive Device for Automotive Vehicle Windows", comprising of a support conveniently fastened to an automobile door, together with a drive lever for the glass. The motor is seated on the support if the device is automatic. The support has a drum on which an appropriate steel cable rolls up, there being also two other vertically aligned supports which, together with the first named support are formed in the shape of a triangle. Each one of the vertically aligned supports has a pulley or grooved pulley that serves as a support and guide for the steel cable, there also being provided, between the upper and lower aligned supports, a vertical guide, conveniently fastened to the door of the vehicle, and inside of which the drive "car" of the glass slides and holds the end of the steel cable.

The device referred to in the Brazilian patent, besides providing a safe and efficient operation, eliminated a series of parts commonly used in traditional mechanisms. This made the mounting much easier, besides reducing the final cost.

With a view toward further simplification of assembly of the device, and also reduction of its cost, the applicant created the present automotive vehicle window drive mechanism in which the two pulleys provided in the aligned upper and lower supports are eliminated, and also the fastening elements of the vertical guide are provided between them.

For this purpose, the mentioned upper and lower supports incorporate internal curved guides for the steel cable, which guides are encased in the supports themselves and perform advantageously the same function as the mentioned pulleys, that is, to guide the cable. Besides this, the guides have inserting elements that permit them to be easily fitted into the free ends of the vertical guide which, consequently, makes unnecessary any fastening element in the automobile door.

With this new construction a series of parts are eliminated and the work of mounting the assembly becomes considerably easier, making the product cheaper than those currently existing and already sold on the market, as a result or reduced production costs.

DESCRIPTION OF THE PREFERRED EMBODIMENTS

For purposes of illustration, drawings of the model now follow by which the invention can be more easily visualized:

Figures 1, 1A, 1B:
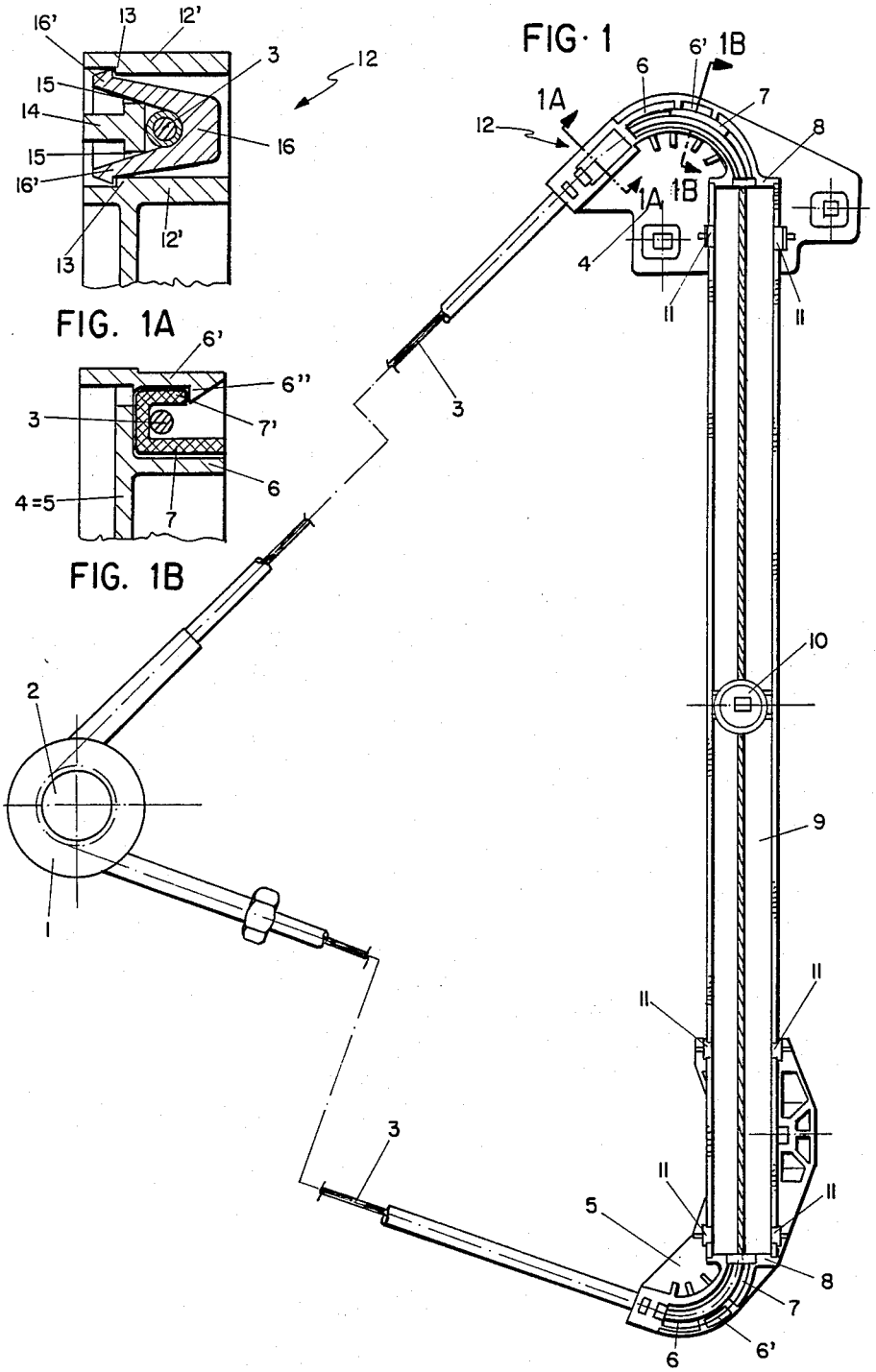
FIG. 1 is a front view of the drive mechanism of the windows, according to the present invention.
FIG. 1A is a fragmentary sectional view, on an enlarged scale, taken along line A—A in FIG. 1.
FIG. 1B is a fragmentary sectional view, on an enlarged scale, taken along line B—B in FIG. 1.
Figure 2:
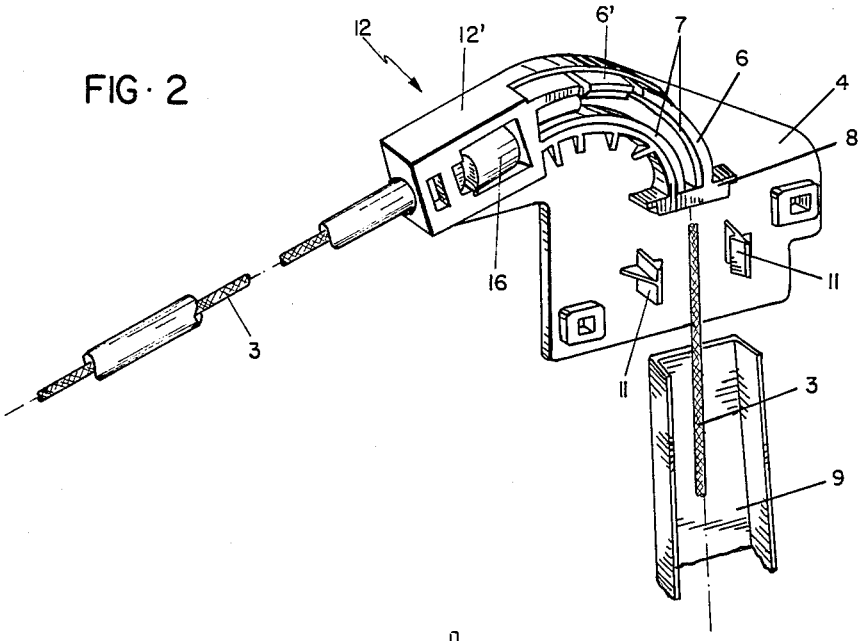
FIG. 2 is a perspective view showing, on an enlarged scale, the upper support and the fitting of the verticl guide.

The present automotive vehicle window drive mechanism includes a support 1 conveniently fastened to the door of the vehicle, coincidentally with a drive lever for the glass, in which a motor is located, in case the mechanism is automatic. This support has a drum 2 on which an appropriate, preferably capped, steel cable 3 is rolled up. The ends of the cable act obliquely, one upward and the other downward, in the direction of two other supports: the upper support 4 and the lower support 5 arranged and aligned vertically and conveniently secured to the door of the vehicle. The three supports are arranged in the figure of a triangle.

The upper support 4 and the lower support 5 have a grooved curve 6 molded in the body of the supports. In the middle of the curve, there is a slightly flexible interrupted section 6' with an upper broader beveled portion limiting the formation of an inside tooth 6'' (see FIG. 1B). In the mentioned groove 6, held under pressure, is a conforming part 7 with a U-shaped profile made of a plastic material or other suitable material that permits the steel cable 3 to slide with a minimum of friction. Part 7 has, at its outside edge and coincidentally with the flexible section 6' of the groove 6, an indentation 7' that, when the part 7 is fitted in the mentioned groove, is held by the tooth 6'' of the flexible section 6', preventing accidental release of the part 7, as illustrated in FIG. 1B.

At the facing and widened ends 8 of the grooves 6, the free ends of a vertical guided rail 9 are fitted, in which the normal "car" 10 slides, moving the glass. The rail 9 has a substantially U-shaped cross-section and is arranged between one or two pairs of lugs 11 which are molded in the supports 4 and 5 themselves, and which assure proper fitting of the rail and supports.

In the upper support 4 and constituting an extension thereof, there is provided a hollow section 12, whose upper and lower walls 12' internally have a region of reduced thickness that produces two internal steps of seats 13. Section 12 is longitudinally bisected in is vertical direction by a dividing wall 14 which has a lying-down, T-shaped cross-section. The upright portion of wall 14 does not reach the full height of the section 12 and that limits the shape of the two openings 15, to allow passage of the legs 16' of a part 16. Part 16 has a cross-section which is generally "U" or "V" shaped, is made of suitable plastic material, and is fitted under pressure in the section 12. The legs of part 16 have free ends with outwardly facing flaps 16' that engage the internal seats 13 of section 12. The part 16 in turn encircles and forces the housing for steel cable 3 against the upright section of the wall 14, forming a positioning element and maintaining the cable 3 in the support 4, as illustrated in FIG. 1A.

Figure 3:
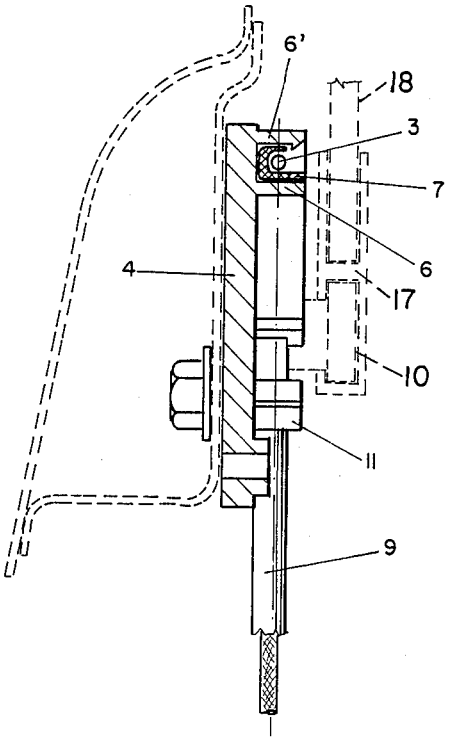
FIG. 3 is a sectional side view of the mentioned support.

The ends of the cable 3, move from the support 1 in the direction of the supports 4 and 5, and enter into the grooves 6 provided in each one. Cable 3 is in contact with the part 7 of plastic material provided inside grooves 6. When leaving these grooves, the ends of cable 3 enter into the rail 9 and are conveniently held to the "car" 10 which drives the glass. As shown in dotted lines in FIG. 3, car 10 projects laterally outwardly from rail 9 and fits inside a holder 17 which forms a support for the glass 18 of the vertical window. Car 10 moves upwardly and downwardly along rail 9 in accordance with the position of the steel cable 3. Car 10 causes glass 18 to move upwardly or downwardly, because it is mounted within holder 17.

With the innovated arrangement, the supports 4 and 5 no longer require the pulleys previously used, since the proper curved grooves 6 mounted in them act as guides for the cable. Besides this, since guide rail 9 is held firmly to the supports 4 and 5, the usual fastening elements of the guide rail to the vehicle door are no longer necessary, thereby providing greater facility in mounting the drive device of the window, as well as reducing the cost, as a result of elimination of parts.

What is claimed is:

1. An automotive vehicle window drive mechanism of the type including a drum support fastened to the vehicle, door, said drum support having a drum on which a steel cable is rolled up, the cable having ends directed obliquely, one upward and other downward, toward an upper and lower support respectively, the upper and lower supports being aligned vertically and being held to the vehicle door, said mechanism comprising:

means defining a curved groove in said upper and lower supports, said groove including an interrupted wall section which is slightly flexible, said wall section being beveled at its outermost end to form a tooth projecting laterally within said groove;

a part of conforming cross-sectional shape press-fitted in said groove so as to form a lining therein, said lining including an indentation, coincident with said flexible section of said groove, positioned and dimensioned to receive said tooth, whereby said lining is retained against withdrawl from said groove;

a "car" secured to said cable between said upper and lower supports, said car being coupled to a glass pane for the vehicle window so as to drive the same;

a guide rail receiving said "car" for vertical movement therein;

means in said upper and lower supports for mounting said guide rail thereto, said mounting means defining a widened end of said groove and engaging the end of said guide rail, and including at least one pair of lugs formed on the respective support so as to engage and retain said guide rail therebetween;

a hollow section formed on at least one of said upper and lower supports so as to receive said cable therein, said hollow section being formed by opposed first and second walls projecting from a surface of said support to form a passageway therebetween, said opposed walls being shaped so that said passageway is wider at an innermost point closest to the surface of said support, a dividing wall formed in the widened portion of said passageway so as to bisect the same and extending into the portion of the passageway of lesser width;

a part having a generally U-shaped cross-section, said legs of said U-shape being formed so as to include laterally divergent projecting portions, said U-shaped part being mounted within said hollow sections so that said projecting portions extend into the widened portion of said passageway;

said cable extending through said hollow section and within said part of conforming cross-sectional shape within the grooves of said upper and lower supports and, between said supports, passing through said guide rail and being secured to said "car".

2. An automotive vehicle window drive mechanism of the type including a drum support fastened to the vehicle door, said drum support having a drum on which a steel cable is rolled up, the cable having ends directed obliquely, one upward and other downward, toward an upper and lower support respectively, the upper and lower supports being aligned vertically and being held to the vehicle door, said mechanism comprising:

means defining a curved groove in said upper and lower supports, said groove including an interrupted wall section which is slightly flexible, said wall section being beveled at its outermost end to form a tooth projecting laterally within said groove; and a part of conforming cross-sectional shape press-fitted in said groove so as to form a lining therein, said lining including an indentation, coincident with said flexible section of said groove, positioned and dimensioned to receive said tooth, whereby said lining is retained against withdrawl from said groove.

3. An automotive vehicle window drive mechanism of the type including a drum support fastened to the vehicle door, said drum support having a drum on which a steel cable is rolled up, the cable having ends directed obliquely, one upward and other downward, toward an upper and lower support respectively, the upper and lower supports being aligned vertically and being held to the vehicle door, said mechanism comprising:

a hollow section formed on at least one of said upper and lower supports so as to receive said cable therein, said hollow section being formed by opposed first and second walls projecting from a surface of said support to form a passageway therebetween, said opposed walls being shaped so that said passageway is wider at an innermost point closest to the surface of said support, a dividing wall formed in the widened portion of said passageway so as to bisect the same and extending into the portion of the passageway of lesser width; and a part having a generally U-shaped cross-section, said legs of said U-shape being formed so as to include laterally divergent projecting portions, said U-shaped part being mounted within said hollow sections so that said projecting portions extend into the widened portion of said passageway.

* * * * *